US007097431B2

(12) United States Patent
Engländer et al.

(10) Patent No.: US 7,097,431 B2
(45) Date of Patent: Aug. 29, 2006

(54) MECHANICAL KINETIC VACUUM PUMP

(75) Inventors: Heinrich Engländer, Linnich (DE); Michael Froitzheim, Dormagen (DE)

(73) Assignee: Leybold Vakuum GmbH, Cologne (DE)

( * ) Notice: Subject to any disclaimer, the term of this patent is extended or adjusted under 35 U.S.C. 154(b) by 64 days.

(21) Appl. No.: 10/415,029

(22) PCT Filed: Aug. 9, 2001

(86) PCT No.: PCT/EP01/09193

§ 371 (c)(1),
(2), (4) Date: Apr. 23, 2003

(87) PCT Pub. No.: WO02/35100

PCT Pub. Date: May 2, 2002

(65) Prior Publication Data

US 2004/0013529 A1 Jan. 22, 2004

(30) Foreign Application Priority Data

Oct. 28, 2000 (DE) ..... 100 53 664

(51) Int. Cl.
*F03B 5/00* (2006.01)

(52) U.S. Cl. ..... 416/241 R; 417/423.4

(58) Field of Classification Search ..... 416/241 R; 415/20, 90, 143; 417/423.4
See application file for complete search history.

(56) References Cited

U.S. PATENT DOCUMENTS

| | | | | |
|---|---|---|---|---|
| 4,309,143 | A | 1/1982 | Klatt et al. | 415/90 |
| 4,812,278 | A * | 3/1989 | Natori et al. | 264/221 |
| 4,992,242 | A | 2/1991 | Faure | 420/535 |
| 5,073,207 | A | 12/1991 | Faure et al. | 148/2 |
| 5,480,299 | A | 1/1996 | Motomura et al. | 432/176 |
| 5,512,241 | A | 4/1996 | Kramer et al. | 420/528 |
| 5,524,699 | A * | 6/1996 | Cook | 164/97 |
| 5,529,748 | A | 6/1996 | Moreton et al. | 420/529 |
| 5,614,036 | A | 3/1997 | Imahashi et al. | 148/437 |
| 5,728,638 | A | 3/1998 | Strange et al. | 501/127 |
| 5,782,609 | A | 7/1998 | Ikemoto et al. | 417/44.1 |
| 5,924,841 | A * | 7/1999 | Okamura et al. | 415/90 |
| 5,925,315 | A * | 7/1999 | Bourkhina | 420/530 |
| 6,059,902 | A * | 5/2000 | Yoshihara et al. | 148/550 |
| 6,077,363 | A * | 6/2000 | Heymes et al. | 148/417 |
| 6,089,843 | A * | 7/2000 | Kondoh | 418/179 |
| 6,095,754 | A | 8/2000 | Ono | 416/224 |
| 6,287,361 | B1 * | 9/2001 | Hauptmann et al. | 75/249 |
| 6,450,772 | B1 * | 9/2002 | Oliver et al. | 417/53 |
| 6,544,357 | B1 * | 4/2003 | Hehmann et al. | 148/420 |

FOREIGN PATENT DOCUMENTS

| | | |
|---|---|---|
| DE | 2654055 B2 | 11/1979 |
| DE | 68906999 T2 | 9/1993 |
| DE | 69006293 T2 | 5/1994 |
| DE | 69307848 T2 | 8/1997 |
| DE | 69414332 T2 | 5/1999 |
| DE | 69422630 T2 | 8/2000 |
| DE | 19918229 A1 | 10/2000 |
| WO | WO 99/57441 | 11/1999 |

* cited by examiner

*Primary Examiner*—Edward K. Look
*Assistant Examiner*—Dwayne J White
(74) *Attorney, Agent, or Firm*—Fay, Sharpe, Fagan, Minnich & McKee, LLP

(57) ABSTRACT

A mechanical vacuum pump includes a rotor made of a light metal alloy by powder metallurgy. The powder metallurgy increases the resistance of the rotor to heat and creep.

16 Claims, No Drawings

MECHANICAL KINETIC VACUUM PUMP

BACKGROUND OF THE INVENTION

The present invention relates to mechanical kinetic vacuum pumps particularly pumps having rotors made of a light metal alloy by powder metallurgy.

By definition gaseous ring vacuum pumps, turbo vacuum pumps (axial, radial) and molecular/turbomolecular pumps belong to the class of mechanical kinetic vacuum pumps. They are capable of mechanically transporting within the molecular flow range (pressures below $10^{-3}$ mbar) the gas particles which are to be pumped. Moreover, molecular pumps are also capable of pumping gases within the Knudsen flow range ($10^{-3}$ to 1 mbar). Preferably employed mechanical kinetic vacuum pumps frequently offer a turbomolecular pumping stage and a downstream molecular pumping stage (compound or hybrid pump), since such a pump is capable of compressing gases up in to the viscous flow range.

Turbomolecular vacuum pumps and compound pumps are employed in production processes of the semiconductor industry. The processes which are applied—etching, coating and the like—are only performed in a vacuum. The mentioned vacuum pumps have the task of evacuating the vacuum chambers before starting the processes and to maintain during the course of the process the desired low pressures.

Turbomolecular vacuum pumps are operated at high rotational speeds (up to 100,000 rpm). For reasons of rotor dynamics the rotors consist of a light metal, commonly an aluminium alloy produced by melt metallurgy, such as casting. The alloy is so adjusted that the rotors offer a high degree of resistance to heat and creep. Creep reduces with increasing rotor temperatures. In the instance of the aluminium alloys employed to date, the creep is acceptable, provided rotor temperatures of 120° C. are not exceeded.

Whilst performing the semiconductor processes, the semiconductor components located within the vacuum chamber attain increased temperatures. This results in an increase in temperature affecting the gases to be conveyed by the vacuum pumps. These gases effect in particular a temperature increase of the rotors in the connected vacuum pumps. Said temperature increase impairs the creep characteristics mentioned, i.e., the rotor temperatures can rise to a temperature at which unacceptable creep starts occurring.

Cooling the rotors of a molecular or turbomolecular vacuum pump is difficult. On the one hand the rotors operate in a vacuum so that no heat is dissipated via the pumped and anyhow hot gases. If the rotors are magnetically suspended, their bearing components will not make contact. Heat dissipation via the magnetic bearings is thus also not effective. If mechanical bearings are provided, the heat of the rotors may be dissipated via the bearings. However, this means of dissipating heat has tight limitations. On the one hand the surfaces of rotor and stator in contact via the rolling bodies are restricted to the almost point shaped contact surfaces of the rolling bodies in their bearing rings. Moreover, due to the presence of a lubricant, the bearings must not attain high temperatures. Also operation of the mechanical bearings themselves incurs the generation of heat. Finally, in general, the drive motor of the pump is a component of the stator and located in the vicinity of the bearings. During those phases where it is operated under a load, it itself forms a source of heat. In this instance a partial transfer of heat between rotor and stator is possible via the gas owing to the increased density. Dissipation of significant quantities of heat via the mechanical bearings would only be possible in the instance of intense cooling of the bearing section on the stator side.

From JP-U-3034699 it is known to coat the active pumping surfaces of a mechanical kinetic vacuum pump in part with a high heat emission coating. Measures of this kind are involved and thus costly.

From the U.S. Pat. No. 6,095,754, a mechanical kinetic vacuum pump for deployment in semiconductor processes is known. It is designed by way of a turbomolecular vacuum pump. In order to attain the target of reducing the duration of semiconductor processes, the task is posed to improve the pumping capacity of the pump. In doing so, the size of the pump is not to be changed. For the purpose of solving this task the employment of a stronger material suited for higher temperatures is proposed preferably for the rotor, specifically a material consisting of a metal as the base material and non-metal additives, like ceramics, for the purpose of reinforcing the base material. Said stronger material allows an increase in rotor speed in order to attain through an increased thermal load a subsequent increase in pumping capacity without changing the size of the pump. The metal cutting process to which the proposed materials are subjected incurs problems owing to the increased share in hard material particles. Rotors for turbomolecular vacuum pumps including the multitude of their blades are commonly turned on a lathe or milled from solid material. The percentage of chips produced in the manufacture of a rotor amounts up to 80%. Thus the manufacture of rotors made of the proposed material is involved and costly.

It is the task of the present invention to increase the resistance to heat and creep for a friction vacuum pump of the aforementioned kind.

SUMMARY OF THE INVENTION

This task is solved through its rotors fabricated of a light metal alloy by powder metallurgy.

DETAILED DESCRIPTION OF THE PREFERRED EMBODIMENTS

Aluminium alloys produced through powder metallurgy (or also through spray deposition) are basically known for other applications. These are manufactured such that the melt consisting of the alloy's constituents is sprayed by nozzles on to a cold surface. Compared to the melt metallurgical manufacture, e.g. casting, of aluminium materials, the melt solidifies very rapidly through which the alloy attains a new structure with changed properties. Aluminium alloys manufactured by spray deposition with the main constituent being copper offer above all a significantly higher strength compared to aluminium alloys manufactured by a melt metallurgical process.

The employment of the material detailed for the rotors of the vacuum pumps of the type affected here permits the manufacture of such pumps with a higher degree of resistance to creep. Provided the aforementioned temperature limit (120° C.) is not exceeded, the (previous) maximum rotational speeds can be increased significantly. Moreover, there exists the possibility of increasing the former maximum permissible temperature to 135° C. and more, without the need of having to reduce the speeds which previously were allowed up to 120° C.

It is known to equip the rotors and stators of molecular/turbomolecular pumps employed in semiconductor processes, said rotors and stators being manufactured based on melt metallurgical processes, with conversion layers (conversion of the aluminium at the surface in to $Al_2O_3$ by anodising, for example) for the purpose of providing protection against corrosion. Since the constituents in the alloy of the new material are metallic and relatively small, there exists as before the advantageous possibility of depositing unbroken conversion layers. The material proposed in U.S. Pat. No. 6,095,754 mentioned above does not allow the deposition of reliable conversion layers.

Materials of the types according to the present invention are being offered on the market under the names of DISPAL/DISPAL S 690 and S 691, for example). Besides aluminium they contain 3.8 to 5.6 percent in weight copper as well as other alloy constituents like magnesium, manganese, zircon, silver and/or titanium at shares of between 0.1 and 1 percent in weight.

In a material of comparable properties, a different light material namely magnesium may be present instead of the aluminium base material. Thus the advantage detailed for alloys based on Al manufactured by powder metallurgy may be also utilised for alloys based on magnesium. The composition of the alloy and the manufacturing processes is adapted correspondingly.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A mechanical kinetic vacuum pump comprising:

a spray deposited aluminum rotor made of an aluminum copper alloy having aluminum and copper as primary constituents, the rotor being adapted to be positioned in said vacuum pump, the alloy being manufactured by spray depositing the alloy on a cold surface.

2. The pump according to claim 1, wherein copper is present in the alloy in copper amounts of 3 to 7 percent in by weight.

3. The pump according to claim 1, wherein the rotor alloy contains magnesium, manganese, zircon, silver in amounts between 0.1 and 1 percent by weight.

4. The pump according to claim 3, wherein the alloy further includes titanium in an amount under 1% by weight.

5. The pump according to claim 3 wherein the alloy further includes copper in amounts of 3 to 7% by weight.

6. The vacuum pump according to claim 1, wherein the rotor rotates relative to a stator making no direct contact with the stator.

7. A mechanical kinetic vacuum pump comprising:

a stationary stator mounted in the vacuum pump;

a rotor rotatably mounted in the vacuum pump to rotate in the stator with no direct frictional contact with the stator, the rotor being made of a spray deposited aluminum alloy having copper in amounts of 3 to 7% by weight.

8. In a kinetic vacuum pump which includes a rotor and a stator that have no direct frictional contact, the improvement comprising:

the rotor being fabricated from a light metal alloy by spray deposition, a primary constituent of the light metal alloy is being one of aluminum and magnesium, the rotor being adapted to be rotationally mounted in said vacuum pump.

9. In a kinetic vacuum pump which includes a rotor and a stator that have no direct frictional contact, the improvement comprising:

the rotor being fabricated from a light metal alloy by spray deposition, the light metal alloy including aluminum and at least one of copper, manganese, zircon, silver, and titanium, the rotor being adapted to be rotationally mounted in said vacuum pump.

10. A spray deposited light metal alloy rotor adapted to be positioned in a kinetic vacuum pump and manufactured by:

spray depositing a light metal alloy to form a light metal rotor by powder metallurgy the light metal alloy including at least one of aluminum and magnesium;

machining the light metal alloy to final rotor dimensions such that the rotor is adapted to be positioned in the vacuum pump.

11. The kinetic vacuum pump rotor as set forth in claim 10 wherein the light metal alloy further includes at least one of copper, manganese, zircon, silver, and titanium.

12. A spray deposited light metal alloy rotor adapted to be positioned in a kinetic vacuum pump and manufactured by:

spray depositing a light metal alloy to form a light metal rotor by powder metallurgy, the light metal alloy including aluminum as a principal constituent and copper in an amount of 3 to 7% by weight;

machining the light metal alloy to final rotor dimensions such that the rotor is adapted to be positioned in the vacuum pump.

13. A spray deposited light metal alloy rotor adapted to be positioned in a kinetic vacuum pump the rotor being manufactured by:

spray depositing a light metal alloy to form a light metal rotor by powder metallurgy;

machining the light metal alloy to final rotor dimensions such that the rotor is adapted to be positioned in the vacuum pump;

anodizing a surface of the rotor to form a corrosion resistant surface conversion layer.

14. A kinetic vacuum pump for pumping gas particles at pressures below 1 mbar, the kinetic vacuum pump including:

a rotor adapted to be positioned in the vacuum pump and which heats to temperatures and rotates at a speed at which aluminum creeps during the pumping interaction with individual gas particles of a vacuum, the rotor being manufactured by powdered metallurgy from an alloy with a primary constituent of one of aluminum and magnesium such that the creep is inhibited.

15. The vacuum pump according to claim 14, wherein the alloy in addition to aluminum includes:

3–7% by weight copper 0.1–1% by weight magnesium;

0.1–1% by weight manganese;

0.1–1% by weight zircon;

0.1–1% by weight silver;

0–1% by weight titanium.

16. The vacuum pump according to claim 14, wherein the rotor is a spray deposited alloy of aluminum which includes 3–7% by weight copper and less than 1% by weight zircon.

* * * * *